United States Patent [19]

Sollami

[11] Patent Number: 4,590,711

[45] Date of Patent: May 27, 1986

[54] SEMI-AUTOMATIC GRINDING MACHINE

[76] Inventor: Phillip A. Sollami, 1300 E. Pine, Herrin, Ill. 62948

[21] Appl. No.: 588,760

[22] Filed: Mar. 13, 1984

[51] Int. Cl.[4] ..... B24B 3/33

[52] U.S. Cl. ..... 51/3; 51/165.9

[58] Field of Search ..... 51/3, 92 BS, 92 R, 92 ND, 51/165.9, 216 ND, 216 T, 219 R, 231, 233

[56] References Cited

U.S. PATENT DOCUMENTS

| | | | |
|---|---|---|---|
| 1,963,394 | 6/1934 | Yassenoff | 51/3 |
| 2,139,938 | 12/1938 | Dixon | 51/219 R |
| 2,746,212 | 5/1956 | Jensch | 51/92 R |
| 2,807,920 | 10/1957 | Householder | 51/219 R |
| 3,898,771 | 8/1975 | Kuniholm | 51/165.9 |
| 3,905,157 | 9/1975 | Sollami | 51/92 BS |

*Primary Examiner*—Frederick R. Schmidt
*Assistant Examiner*—Robert A. Rose
*Attorney, Agent, or Firm*—Edmond T. Patnaude

[57] ABSTRACT

A semi-automatic grinding machine for grinding the tips of carbide miner bits. The machine includes two rotary holders, one semi-automatic holder for grinding a heel on the miner bit carrier, and a second automatic holder for grinding the bit tip. An electrical-pneumatic control system automatically brings the bit in contact with the grinding wheel under controlled pressure, reciprocates the bit across the grinding wheel, retracts the bit from the grinding wheel and releases the bit from the holder. Provision for compensating for changes in the radial dimension of the grinding wheel are included.

7 Claims, 5 Drawing Figures

SEMI-AUTOMATIC GRINDING MACHINE

BACKGROUND OF THE INVENTION

This invention relates to grinding machines. More particularly the invention relates to a semi-automatic grinding machine for sharpening drill bits of the type used for mining coal known as miner bits.

Miner bits comprise a carbide tip that is inserted into a steel carrier. The cutting tip of the bit is conical and wears during use. Heretofore, it has been more economical to dispose of used miner bit cutters rather than sharpen them, first, because the conical tip could not be accurately sharpened by hand, and further, because the tip often wears down to such a degree that interference between the carrier and a grinding wheel used to grind the tip is created precluding grinding of the carbide tip at the proper angle. This has resulted in large numbers of otherwise good miner bits being discarded which is economically wasteful.

SUMMARY OF THE INVENTION

The present invention provides for a semi-automatic grinding machine for sharpening conically shaped tools such as a miner bit. The preferred embodiment includes a controlled movement carriage on which a controlled rotary tool holder is mounted. The rotary tool holder positions the tool at the proper angle with respect to a grinding wheel and rotates the tool to generate the desired shape. The holder is automatically opened and closed at the end and beginning of each grinding cycle.

In accordance with another feature of the invention, the carriage is automatically moved to position the tool against the grinding wheel and to retract the tool upon completion of the grinding. Also, a second carriage simultaneously reciprocates the tool across the face of the grinding wheel.

And, another important feature provides a second rotary tool holder for positioning the tool bit carrier against an abrasive belt for grinding a heel on the carrier to provide a clearance between the carrier and tool bit grinding wheel allowing the desired angle to be ground on the tool bit.

A further feature of the invention provides for adjustment of the pressure exerted on the grinding wheel by the tool during the grinding thereof and also provides for compensating for radial wear of the grinding wheel.

BRIEF DESCRIPTION OF THE DRAWINGS

The present invention will be better understood by a reading of the following detailed description taken in connection with the accompanying drawings wherein.

DETAILED DESCRIPTION OF THE PREFERRED EMBODIMENT

The grinding machine is similar in construction to that machine disclosed in my U.S. Pat. No. 3,905,157 for Grinding Machine for Sharpening the Cutting Edges of a Tool and the disclosure of that patent is to be considered incorporated into the disclosure of this application. Similarly, the rotary tool holder disclosed in my co-pending application Ser. No. 588,922, filed Mar. 13, 1984, is also used in the machine of the present invention and the disclosure of that application is also to be considered to be incorporated into the disclosure of this application. Therefore, details of the structure which are disclosed in that patent and application will not be set out here except where necessary to an understanding of the present invention. Differences in the structure and operation between that of the above patent and application and the present invention are disclosed herein where appropriate.

Figure 1:
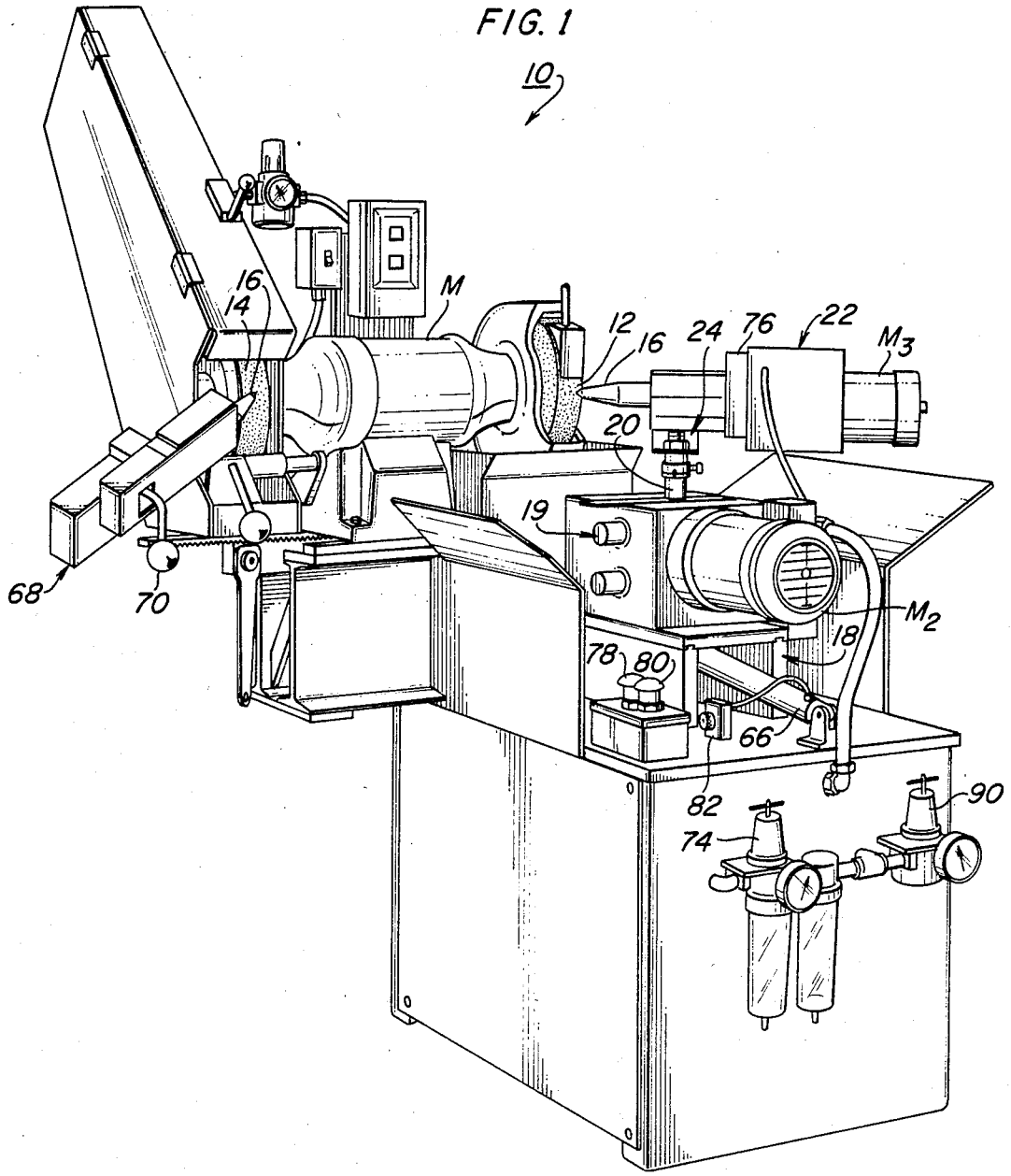
FIG. 1 is a perspective view of the preferred embodiment.

Shown in FIG. 1 is a semi-automatic grinding machine 10 for use in sharpening miner bits. While the grinding machine is disclosed for use in sharpening miner bits, those skilled in the art can readily use the machine for sharpening and grinding other work pieces, and the invention is not to be considered limited to that application. Grinding machine 10 includes a motor driven grinding wheel 12 and preferably a motor driven abrasive belt 14. Abrasive belt 14 is used for grinding a heel on a tool carrier 16 as set out below. Grinding wheel 12 is used to grind the surface of the workpiece, also as set out below.

Figure 3:
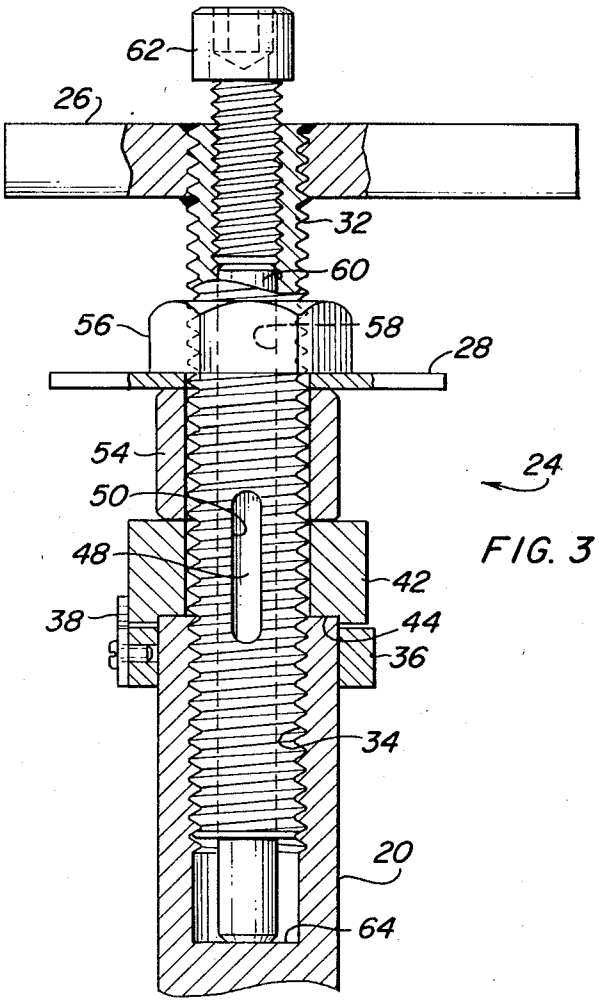
FIG. 3 is a cross-sectional view along 3—3 of FIG. 2.
Figure 2:
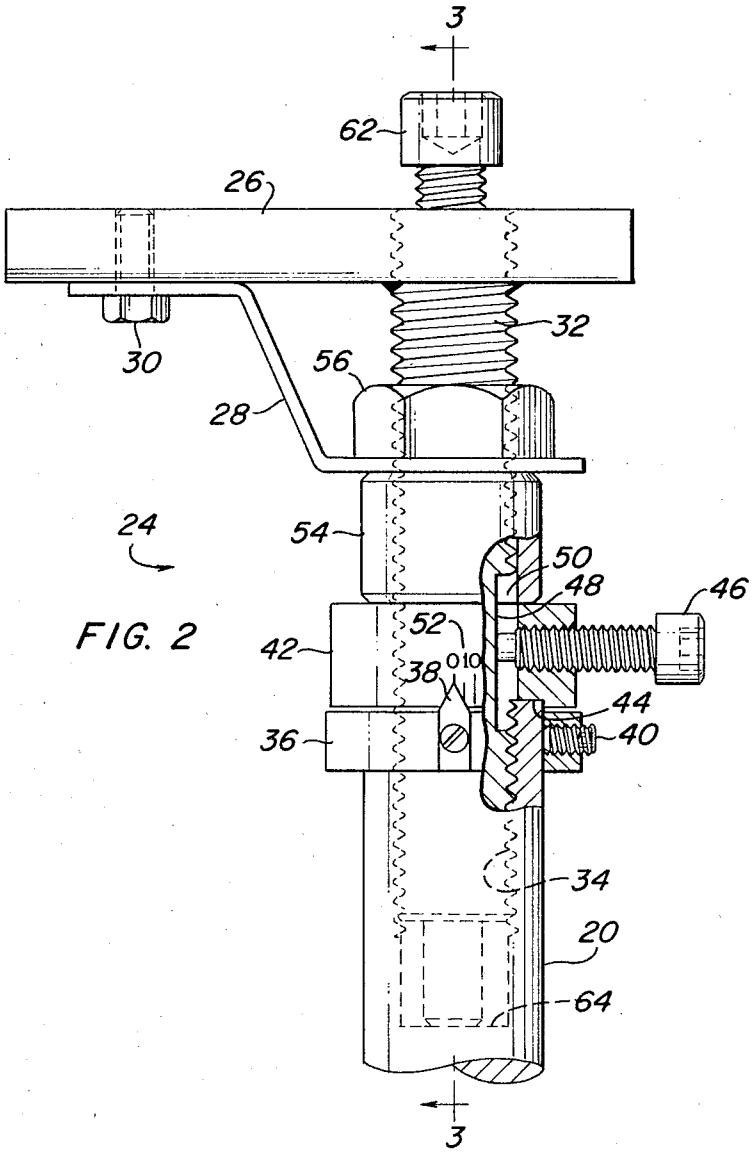
FIG. 2 is an elevational view in partial cross section of the tool holder mounting.

Grinder 10 is provided with a first carriage assembly 18 that is mounted for reciprocal movement toward and away from grinding wheel 12. A second carriage assembly 19 is mounted to first carriage assembly 18 for reciprocal movement transverse to the direction of movement of the first carriage and to the surface of grinding wheel 12. An upstanding post 20 is carried on the second carriage assembly as shown in FIG. 1. An automatic opening and closing rotatably driven tool holder 22 is mounted on the distal end of post 20. Holder 22 is adjustably mounted to post 20 through an attachment 24 shown in FIGS. 2 and 3. Holder 22, not shown in FIGS. 2 and 3, is attached to a base plate 26 which includes a mounting bracket 28 fastened thereto by fasteners 30. A threaded rod 32 is threaded into or otherwise fixedly secured to base plate 26 and passes through an aperture in bracket 28. Upstanding post 20 includes an internally threaded receptical 34 into which the free end of rod 32 is threaded.

A collar 36 surrounds the external surface of post 20 and carries a scale pointer 38. Collar 36 is rotationally and axially retained on post 20 by a set screw 40 which passes through the collar wall and engages the outer surface of post 20. A second collar 42 surrounds rod 32 and includes an annular recess 44 into which the end of the post 20 fits. Collar 42 is rotatable around rod 32 on the end of post 20 and is retained to rod 32 by a set screw 46 which passes through the wall of the collar and engages recessed surface 48 of a slot 50 in rod 32. When set screw 46 is backed out of slot 50, rod 32 may be rotated to extend or retract from post 20 to change the vertical position of the holder to the extent of the length of slot 50.

Collar 42 carries a scale 52 calibrated in degrees which, when calibrated as set out below, cooperates with the pointer on collar 36 to indicate the angular position of the holder relative to the grinding wheel surface.

Interposed between collar 42 and bracket 28 is a spacer 54 for supporting the bracket which is retained by a nut 56.

Referring to FIG. 3, rod 32 includes an axial bore 58 in which a locking rod 60 is slidably positioned. The upper end of rod 32 includes internal threads for receiving a locking bolt 62. Locking bolt 62 is axially aligned with locking rod 60 and, when tightened, forces the locking rod down against bottom surface 64 of the post recepticle which locks the threaded rod against rotation. As stated, workpieces other than miner bits can be ground with the machine described herein. For example, a common twist drill having a conically shaped surface can be inserted into the holder for rotation against the grinding wheel. Whenever the workpiece holder 22 is angularly positioned with respect to the grinding wheel such that the desired surface shape will be generated as the workpiece is brought into contact with the wheel. Holder 22 rotates in a direction opposite to that of the grinding wheel.

As set out in the above mentioned patent, the first carriage is controllably reciprocated between a grinding wheel position, whereat the tool is in contact with the grinding wheel, and a loading position, whereat the carriage and tool are positioned away from the grinding wheel, by an air cylinder 66. The air cylinder is controlled by a pneumatic and electrical control system set out herein below.

As also set out in the above mentioned patent, the second traversing carriage is controllably reciprocated transversely to the grinding wheel by a reciprocating motor M2 and accompanying structure set out in the patent. The reciprocating and traversing second carriage assembly causes the tool to move back and forth across the grinding wheel surface as the tool is simultaneously rotated by the holder. Reciprocating motor M2 is also controllably operated by the control system described below.

Rotary tool holder 22, as stated is preferably that holder described in the above mentioned co-pending application. That holder features fluid pressure activated collet that is controllably opened and closed to facilitate quick release and removal of the finished tool and fast insertion and engagement of a tool to be surfaced. The holder is driven by a motor M3 and features motor anti-lock up structure should the tool or spindle thereof become jammed.

Figure 4:
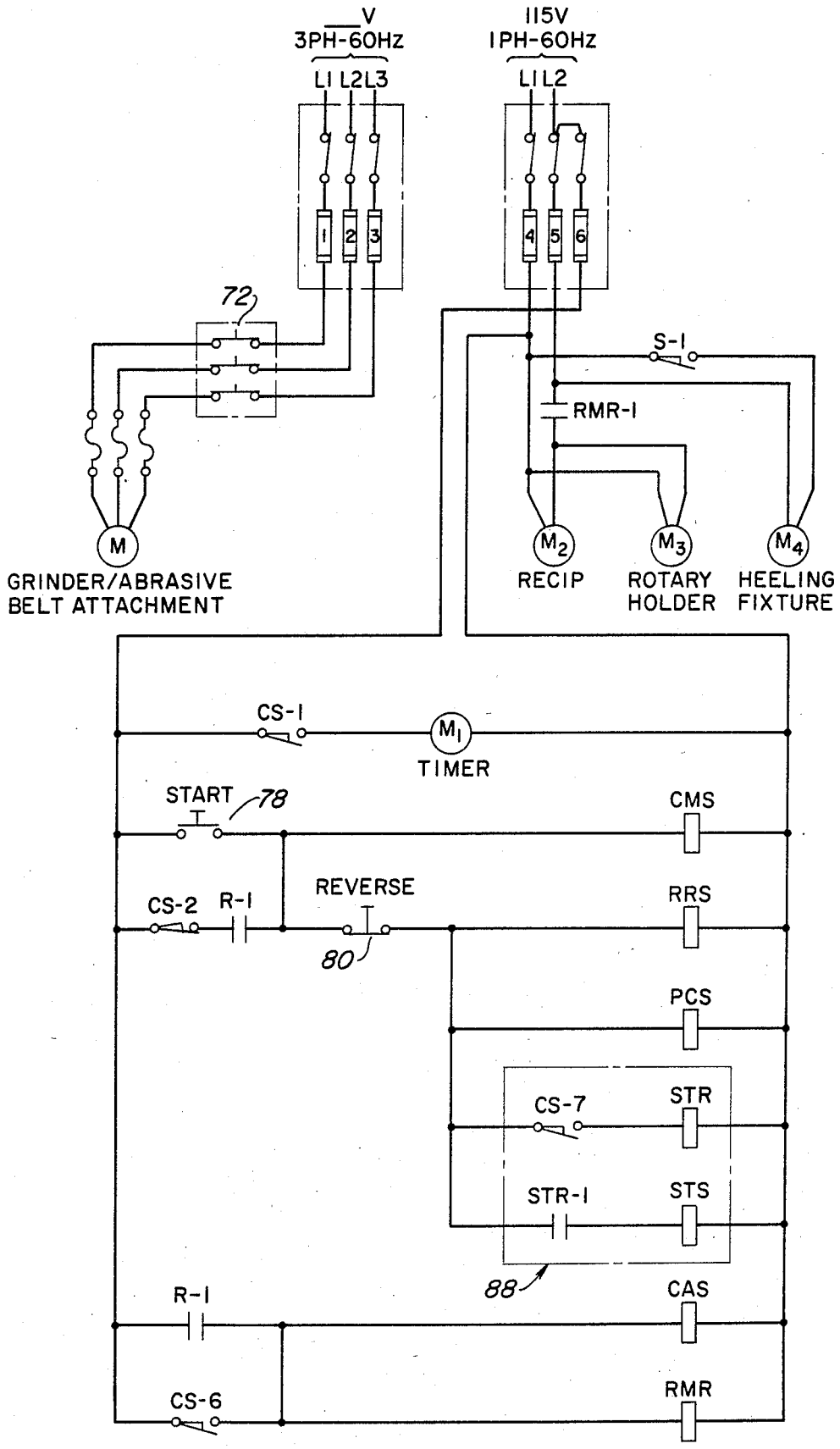
FIG. 4 is a schematic representation of the electrical control system.

In grinding miner bits, the bit carrier, which is typically made from hardened alloy steel, is normally of such a size and shape that it is not possible to bring the bit held therein into contact with the grinding wheel at the proper angle when the carrier is held in the rotary holder. The carrier external surface near the bit extends outwardly such that it interferes with the grinding wheel when the holder is positioned at the desired angle. Therefore, the carrier surface must be supplied with a heel by grinding down the surface adjacent to the bit prior to insertion into the rotary holder to provide clearance between the carrier and grinding wheel. In the art, this is known as heeling the tool carrier. To do so, a second rotary tool holder 68, called a heeling fixture, is mounted adjacent abrasive belt 14. Holder 68 acts as a fixture for heeling tool carrier 16 and is constructed similarly to rotary tool holder 22, but its operation is achieved semi-automatically. The manipulation and operation of holder 68 could be carried out entirely automatically, but the increased complexity for such controls may not be justified in light of the fact that semi-automatic operation is just as effective. In any case, the heeling fixture is designed such that, when lever 70 is moved forward, toward the abrasive belt, the holder opens allowing the carrier to be inserted therein. When the lever is moved to the extreme rearward position, away from the abrasive belt, an internal switch S1, see FIG. 4, is closed causing an electrical motor M4 to rotate the carrier. The holder is then manually angularly positioned with respect to the abrasive belt such that, when the holder is rotated to bring the carrier in contact with the belt, an annular heel is ground on the carrier surface adjacent to the tool bit. After heeling the carrier, it is removed by moving lever 70 forward which opens switch S1 stopping motor M4 and causes the holder to open and release its hold on the carrier. The carrier is then ready to be inserted into rotary tool holder 22 for resurfacing the tool bit.

OPERATION

Figure 5:
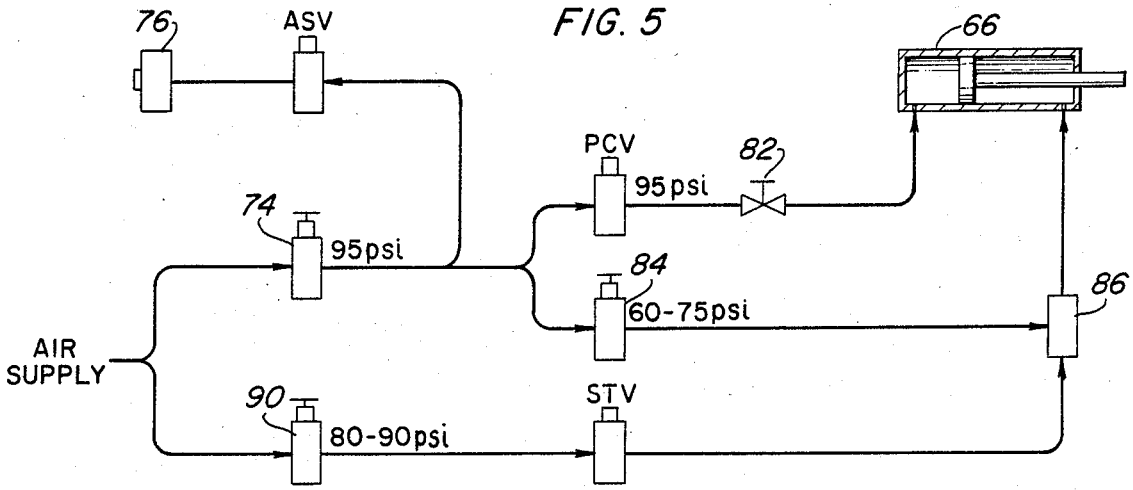
FIG. 5 is a diagramatic representation of the pneumatic control system.

The operation of the grinder will be understood by referring to FIGS. 4 and 5 wherein the electrical controls and pneumatic controls are shown. To resurface, for example, a heeled miner bit, the vertical position of the tool holder relative to the grinding wheel is adjusted first by backing out set screw 46 to clear slot surface 48, loosening locking bolt 62 and then rotating threaded rod 32 to extend or retract from post 20.

Second, the holder is adjusted on post 20 so as to position the tool at the desired angle relative to the grinding wheel. After calibrating the scale to indicate the angular position of the holder from a reference position, as set out herein, subsequent changes in the angle of the holder can be made by simply loosening locking bolt 62 and rotating the holder until the appropriate degree marking on the scale is opposite the pointer, and then retightening the locking bolt. The initial reference position and calibration of the scale is made, for example, by positioning the holder parallel to the ginding wheel surface and tightening bolt 62 to insure that the holder will not move therefrom. Collar 42 is secured on rod 32 by tightening set screw 46 against slot surface 48. This locks the scale 0 degree mark at a reference position, in this case, to indicate the holder is parallel to the grinding wheel surface. Collar 36 is then rotated on post 20 until the pointer aligns with the 0 degree mark and set screw 40 is tightened. Holder 22 can then be rotated and positioned at known angles relative to the grinding wheel surface as indicated on the scale. A 0 degree setting, in the example here, positions the holder and tool parallel to the grinding wheel surface and a 90 degree setting positions the holder and tool perpendicular thereto. Of course, other reference positions could be chosen to set the scale 0 degree setting. The scale will remain calibrated so long as collar 36 is not moved.

After positioning the tool vertically and angularly, grinding wheel 12 and abrasive belt 14 are set in motion by closing manual switch 72. Switch 72 completes the circuit to grinder/abrasive motor M. Air regulated to about 95 psi by regulator 74 is continuously supplied to a holder collet actuator 76 through an actuator solenoid valve ASV and keeps the collet in a normally open position allowing the tool carrier to be inserted therein. Upon closing manual start switch 78, a coil of a timer motor solenoid CMS is energized which causes a set of switch contacts CS-1 to close. The closing of switch contacts CS-1 completes the circuit to a timer motor M1. Timer motor M1 operates a cam shaft and cams which in turn operate in timed relationship switch contacts as set out hereinbelow.

The closing of start switch 78 also energizes a reverse relay solenoid RRS through a normally closed manually operated reversing switch 80. Reverse relay solenoid RRS picks up to close a set of relay contacts R-1. Timer motor M1 begins rotating the cams and holds contacts CS-1 closed and also closes a set of cam operated switch contacts CS-2. Manual start button switch 78 can then be released and the circuit for operating timer operator motor M1 and the other controls as set out below is completed through switch contacts CS-2, relay contacts R-1 and normally closed reversing switch 80. With cam operated switch contacts CS-2 closed a carriage push return cylinder solenoid PCS is energized. The push return solenoid opens a port in a push return cylinder valve PCV, see FIG. 5, allowing air regulated to about preferably 95 psi to pass through flow control valve 82 into the push return cylinder on the back side of the piston (front of the machine). The air pressure causes the piston to move the carriage toward the grinding wheel and to the position for grinding the tool surface.

Another set of cam operated switch contacts CS-6 are closed by the timer motor cam simultaneously with the closing of switch contacts CS-2. The closing of relay contacts R-1 also energizes a collet actuator solenoid CAS and a reciprocating motor relay RMR. Switch contacts CS-6 maintain the collet actuator solenoid and reciprocating motor relay energized for a few seconds after relay contacts R-1 drop out near the end of the cycle or during any reverse sequence when reverse switch 80 is opened before the cam switch timer completes its cycle. Collet actuator solenoid CAS closes an air supply port in collet actuator solenoid valve ASV and vents the air supply line between the collet actuator supply valve and collet actuator 76, thereby causing the actuator to retract the collet to the closed position to hold the tool carrier. Reciprocating motor relay RMR picks up to close a set of contacts RMR-1 which completes the AC supply line circuit to reciprocating motor M2. Relay contacts RMR-1 also simultaneously complete the circuit to rotary holder motor M3 causing the collet to rotate the tool carrier and tool. The reciprocating mctor M2, through the associated mechanical components, causes the second carriage and tool to reciprocate across the face of the grinding wheel. The tool is thereby moved against the grinding wheel by the first carriage and reciprocated across the face of the wheel by the second carriage movement. The tool is also rotated opposite to the direction of the grinding wheel by motor M3. In this fashion a conically shaped surface is ground on the tool.

As set out above, the air for operating collet actuator 76 and push return cylinder 66 is reduced from line pressure down to preferably about 95 psi by regulator 74. The air flow to the push return cylinder passes through flow control valve 82 which controls the rate at which the air is allowed to enter the cylinder and therefore the rate at which the pressure differential across the piston builds, thereby providing for adjustment of the rate of forward motion of the piston and carriage toward the grinding wheel. With push return cylinder valve PCV closed, the push return cylinder piston has a pressure differential of between preferably 60 psi and 75 psi maintained across it by a lower pressure supply of air applied to the front of the piston (rear of the machine) through regulator 84 and shuttle valve 86. The pressure differential causes the carriage to return to the loading position upon removal of the higher pressure air on the back side of the piston when valve PCV closes.

An important feature of the machine includes a soft touch feature generally shown by the numeral 88 in FIG. 4 and provides a third regulator 90 and solenoid operated valve STV referred to as a soft touch solenoid operated valve. Soft touch regulator 90 is set to reduce the supply air pressure to about 5 to 15 psi below that of the pressure supplied to the backside of the piston through flow control valve 82. When energized, soft touch solenoid valve STV allows the regulated air to pass through to shuttle valve 86 whereat it overrides the lower pressure air from regulator 84 and passes into cylinder 66 on the front of the piston. Because the soft touch air supply is less than that supplied to the rear side of the piston through flow valve 82 by about 5 to 15 psi, the differential causes the piston speed to slow considerably, thereby causing the motion of the carriage and tool toward the grinding wheel to slow. The slowed motion continues as the tool contacts the wheel and provides a reduced pressure between the wheel and tool. It can be appreciated that wheel life is prolonged, less heat is generated due to the reduced pressure between the wheel and tool and a high quality surface is ground on the tool. The soft touch pressure differential is preset, and it has been found that a pressure differential of about 5 to 15 psi across the push return piston is acceptable.

The soft touch feature is accomplished by causing another set of cam operated contacts CS-7 to be closed by the timer motor operated cam at a predetermined time into the cycle. When contacts CS-7 close, a soft touch relay STR picks up to close a set of contacts STR-1. The closing of relay contacts STR-1 completes a circuit to a soft touch solenoid STS which opens the soft touch valve STV allowing the higher pressure air to flow through shuttle valve 86 into cylinder 66. It has been found that closing contacts CS-7 at about 10% to 15% into the cycle is acceptable. The soft touch feature of the carriage is therefore operational for about the latter 85% to 90% of the cycle and advances the tool against the wheel with reduced pressure as it is simultaneously moved transversely across the wheel face.

Another feature of the machine provides for compensating for radial wear of the grinding wheel. Because the carriage and tool forward motion toward the grinding wheel will start to slow under the influence of the soft touch feature at the same time into each cycle, as determined by the motor driven cam, as the wheel wears radially, there is an ever increasing distance between the tool and wheel surface at the predetermined time that the soft touch solenoid valve is energized. The tool must therefore travel farther to reach the wheel which results in a reduced contact time therewith and reduced grinding time. To compensate, flow valve 82 is provided in the supply line to the rear side of the piston. For a new grinding wheel, flow valve 82 can be turned to be partially closed to restrict the flow of air to the cylinder and therefore reduce the time it takes for the pressure differential to build across the piston within the cylinder and thereby reduce the speed of the piston and carriage. The valve is adjusted such that the carriage and tool move to the proper position whereat, when the soft touch feature is activated by the closing of contacts of CS-7, the tool will be preferably immediately adjacent the grinding wheel surface and will be urged by the soft touch motion against the wheel during substantially the entire period of the soft touch operating time. As the grinding wheel wears, flow valve 82 is opened manually to increase the rate at which the pressure differential builds across the piston. The carriage therefore moves towards the grinding wheel faster and reaches the wheel again preferably just as the soft touch feature is activated even though it had slightly farther to travel. Those experienced with the machine can readily adapt to provide the right amount of adjustment to valve 82 so as to accomplish the correct change in carraige feed speed. At the end of the timer cycle, the cam first opens switch contacts CS-2 which causes reverse relay solenoid RRS to drop out which opens contacts R-1 and the circuit to push cylinder solenoid PCS. When push cylinder solenoid PCS is de-energized, push cylinder operating valve PCV closes which shuts off the air supply to cylinder 66. The pressure applied to the front of the piston through regulator 84 causes the piston to return the carriage to the loading position.

The cam then causes switch contacts CS-6 to open dropping out reciprocating motor relay RMR which opens reciprocating motor relay contacts RMR-1 which stops reciprocating motor M2 and rotary holder motor M3. The opening of contacts CS-6 also de-energizes collet actuator solenoid CAS which opens actuator solenoid valve ASV to it normally open position thereby supplying air to the actuator. The actuator opens the collet so that the tool may be removed therefrom. Finally, as the timer completes the cycle, the cam opens contacts CS-1 causing the timer motor M1 to stop.

Also, the machine can be stopped anytime during its operational cycle by manually opening reverse switch 80 which causes the same sequency of events heretofore set out to occur as if switch contacts CS-2 has been opened.

Having described the preferred embodiment of the invention those skilled in the art having the benefit of said description and the accompanying drawings can readily devise other modifications and embodiments. Therefore, said other embodiments and modifications are to be considered to be incorporated within the scope of the appended claims.

What is claimed is:

1. A machine for grinding a workpiece comprising:

a rotatably driven grinding wheel having a grinding surface;

a workpiece holder having controllable rotation and workpiece engagement and release for holding and rotating said workpiece relative to said grinding wheel surface;

means for controllably moving said holder toward and away from said grinding wheel to bring said workpiece into contact with said grinding wheel surface and to retract said tool therefrom;

means for controllably reciprocating said workpiece holder parallel to said grinding wheel surface for moving said workpiece back and forth across said surface of said grinding wheel when said workpiece is brought into contact therewith by said means for moving said holder;

means for reducing the speed of movement of said first holder toward said grinding wheel at a predetermined time after the start of said movement so that said workpiece is brought into contact with said grinding wheel surface at said reduced speed;

means for adjusting the speed of movement of said first holder toward said grinding wheel during the period of said movement ending at said predetermined time providing for repetitive positioning of said workpiece the same distance from said grinding wheel surface at said predetermined time as said grinding wheel radial dimension changes; and control means for causing said holder to engage and rotate said workpiece, for causing said means for moving to start movement of said holder toward said grinding wheel, and for causing said means for reciprocating to reciprocate said holder, and for causing, at said predetermined time, said means for reducing to reduce the speed of motion of said holder, and advance said rotating and reciprocating workpiece against said wheel surface at said reduced speed to grind the workpiece, then for causing said means for moving to retract said holder away from said grinding wheel, for causing said means for reciprocating to stop reciprocation of said holder, and for causing said holder to stop rotation and release said workpiece.

2. The machine as defined in claim 1 further comprising:

a second rotatably driven grinding member; and a second rotatably driven workpiece holder adjustably mounted for holding and rotating a carrier member within which said workpiece is held relative to said second grinding member to grind a surface on said carrier member providing clearance between said carrier member and grinding wheel when said carrier member is engaged in said workpiece holder for grinding said workpiece.

3. A grinding machine for grinding a surface on a tool comprising:

a rotatably driven grinding wheel having a peripheral grinding surface for grinding said tool;

a first carriage mounted for reciprocal movement between a loading position and a grinding position;

means for controllably moving said first carriage between said loading and grinding position for bringing said tool in contact with said grinding wheel and for retracting said tool therefrom;

a second carriage mounted to said first carriage for reciprocal movement parallel to the surface of said grinding wheel;

means for controllably reciprocating said second carriage;

a tool holder having controlled rotation and controlled tool engagement and release adjustably mounted to said second carriage for holding and rotating said tool relative to said grinding wheel surface, said tool holder including a first upstanding member fixedly attached to said second carriage and a second upstanding member rotatably mounted to said first upstanding member, said holder being fixedly mounted to said second upstanding member;

means for releasably locking said second upstanding member against rotation at selected angular positions relative to said grinding wheel surface, said means for releasably locking including a central passage provided through said second upstanding member, a locking rod slidably received within said passage having one end in contact with a surface of said first upstanding member, and a locking bolt threadedly received in said second upstanding member central passage adjacent the opposite end of said locking rod, whereby said locking rod is urged against said surface when said locking bolt is advanced into contact with said rod and said first upstanding member and second upstanding member are frictionally restrained against relative rotation; and control means for causing said tool holder to engage and hold said tool and to rotate, for operating said means for moving said first carriage to move said first carriage to said grinding position whereat said tool is against said grinding wheel surface, for operating said means for reciprocating said second carriage to reciprocate said second carriage and move said tool back and forth across said grinding wheel surface, then for operating said means for moving said first carriage to move said first carriage to the loading position, for operating said means for reciprocating said second carriage to stop reciprocation of said second carriage, and for causing said tool holder to stop rotation and to release said tool.

4. The machine as defined in claim 3 further comprising:

indicating means associated with said first and second upstanding members for indicating the angular position of said second upstanding member relative to said grinding wheel surface.

5. The machine as defined in claim 4 wherein said indicating means comprises:

a scale calibrated in angular degrees mounted to said second upstanding member; and an indicator mounted to said first upstanding member adapted to be positioned and releasably locked on said first upstanding member relative to a reference angle on said scale reflecting a preset angular position of said holder relative to said grinding wheel surface, whereby the angular position of said second upstanding member and holder thereon from said preset angular position relative to said grinding wheel surface is indicated on said scale opposite said indicator.

6. The machine as defined in claim 5 wherein said scale is carried on a first collar surrounding said second upstanding member; and said indicator is carried on a second collar surrounding said first upstanding member releasably locked thereto by a set screw.

7. The machine as defined in claim 6 wherein said second upstanding member includes a slot parallel to the principal longitudinal axes of said first and second upstanding members; and a set screw extends through said first collar surrounding said second upstanding member into said slot to rotationally and axially releasably lock said first collar and scale to said second upstanding member, said second upstanding member and holder being adjustably positioned axially relative to said first upstanding member along the length of said slot for vertically positioning said holder relative to said grinding wheel surface.

* * * * *